US010485305B2

(12) United States Patent
Hansson et al.

(10) Patent No.: US 10,485,305 B2
(45) Date of Patent: Nov. 26, 2019

(54) PASSENGER SAFETY BELT BUCKLES

(71) Applicant: Rockwell Collins, Inc., Cedar Rapids, IA (US)

(72) Inventors: Charles Martin Hansson, Winston-Salem, NC (US); Jaan Lin, Winston-Salem, NC (US); Brian P. Wenger, Kernersville, NC (US); Michael Princip, Winston-Salem, NC (US); Alex L. Velet, Clemmons, NC (US); Thomas Martz, Winston-Salem, NC (US); Glenn A. Johnson, Rural Hall, NC (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 15/948,815

(22) Filed: Apr. 9, 2018

(65) Prior Publication Data

US 2019/0307212 A1 Oct. 10, 2019

(51) Int. Cl.
*A44B 11/00* (2006.01)
*A44B 11/25* (2006.01)

(52) U.S. Cl.
CPC ..... *A44B 11/001* (2013.01); *A44B 11/2503* (2013.01)

(58) Field of Classification Search
CPC ..... A44B 11/001; A44B 11/2503
See application file for complete search history.

(56) References Cited

U.S. PATENT DOCUMENTS 4,502,188 A * 3/1985 Kohli ..... A44B 11/001 24/163 K
5,765,265 A * 6/1998 Kang ..... A44B 11/24 24/177
5,926,927 A * 7/1999 Winkler ..... A41F 1/008 24/593.1
6,237,197 B1 * 5/2001 Donahue ..... A44B 11/005 24/166
10,064,452 B1 9/2018 Faruque et al.
(Continued)

FOREIGN PATENT DOCUMENTS

GB 2524978 A 10/2015
WO 2010112875 A2 10/2010

OTHER PUBLICATIONS

Partial European Search Report dated Jul. 15, 2019 for EP Application No. 19167541.2.

*Primary Examiner* — Robert Sandy
*Assistant Examiner* — David M Upchurch
(74) *Attorney, Agent, or Firm* — Suiter Swantz pc llo

(57) ABSTRACT

Passenger safety belt buckles are disclosed. In embodiments, a safety belt buckle includes a base member and a release member coupled to the base member. The release member is configured to release a tongue held between the release member and the base member when the release member is pulled away from the base member. In an example embodiment, the release member is formed by a plurality of printed device layers and a metal coating disposed over the plurality of printed device layers. In another example embodiment, the release member is formed by a plurality of printed metal layers. In yet another example embodiment, the release member includes a recess with an in-mold feature disposed within the recess.

16 Claims, 31 Drawing Sheets

(56) References Cited

U.S. PATENT DOCUMENTS

| | | | | |
|---|---|---|---|---|
| 2007/0058361 | A1* | 3/2007 | Sevilla, II | A44B 11/001 362/103 |
| 2012/0284972 | A1* | 11/2012 | Hafdal | A44B 11/001 24/457 |
| 2013/0008056 | A1* | 1/2013 | Vincent | A43B 5/04 36/117.1 |
| 2013/0276269 | A1* | 10/2013 | Su | A44B 11/001 24/303 |
| 2014/0075723 | A1* | 3/2014 | Iten | A44B 11/226 24/193 |
| 2014/0259303 | A1* | 9/2014 | Eliason | A44B 11/001 2/338 |
| 2016/0246392 | A1* | 8/2016 | Liu | G09G 3/3406 |
| 2017/0245600 | A1* | 8/2017 | Ozburn | A44B 11/001 |
| 2018/0154862 | A1* | 6/2018 | Wedeking | F16H 31/002 |

* cited by examiner

PASSENGER SAFETY BELT BUCKLES

BACKGROUND

Vehicles for mass transport can include, but are not limited to, aircrafts, boats, trains, and busses. The passenger cabins in these types of vehicles are typically designed for long travel durations (e.g., one or more hours of travel). Turbulence may be encountered during travel, and as such, passengers are encouraged to wear safety belts (e.g., seat belts) at all times when the passengers are not moving throughout the cabin (e.g., to use the restroom, to retrieve an item, etc.).

The structure and visual appearance of safety belt buckles can be important. For example, it may be desirable to provide different safety belt buckles for first class or business class cabins than those provided for economy cabins. It can also be desirable to provide customized safety belt buckles. Current techniques for manufacturing safety belt buckles, such as metal casting, are not well-suited for manufacturing small batches. Thus, customized safety belt buckles may have a high expense. There is a need for improved techniques for manufacturing safety belt buckles, particularly customized safety belt buckles.

SUMMARY

In one aspect, embodiments of the inventive concepts disclosed herein are directed to passenger safety belt buckle structures and techniques for manufacturing the same. In embodiments, a safety belt buckle includes a base member and a release member coupled to the base member. The release member is configured to release a tongue held between the release member and the base member when the release member is pulled away from the base member. In an example embodiment, the release member is formed by a plurality of printed device layers and a metal coating disposed over the plurality of printed device layers. In another example embodiment, the release member is formed by a plurality of printed metal layers. In yet another example embodiment, the release member includes a recess with an in-mold feature disposed within the recess.

This Summary is provided solely as an introduction to subject matter that is fully described in the Detailed Description and Drawings. The Summary should not be considered to describe essential features nor be used to determine the scope of the Claims. Moreover, it is to be understood that both the foregoing Summary and the following Detailed Description are example and explanatory only and are not necessarily restrictive of the subject matter claimed.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or may be represented schematically in the interest of clarity. Like reference numerals in the drawings may represent and refer to the same or similar element, feature, or function. In the drawings.

DETAILED DESCRIPTION

Figure 1:
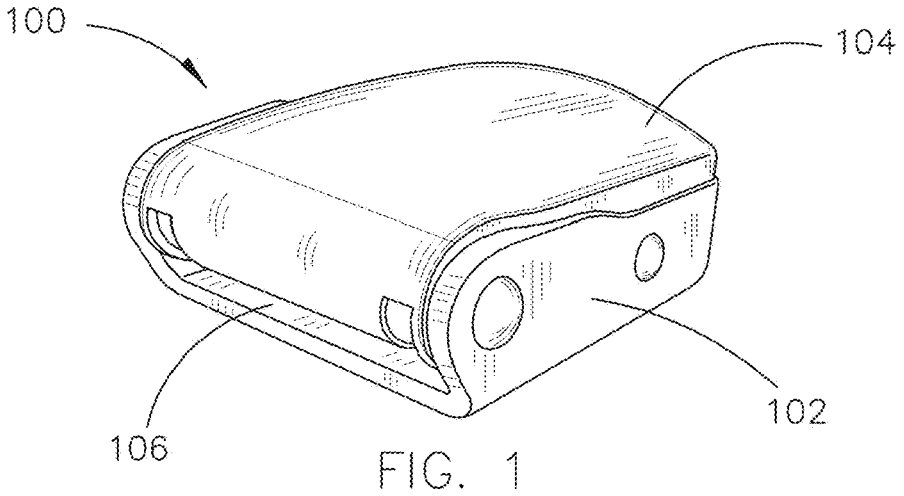
FIG. 1 is a perspective view of a safety belt buckle, in accordance with an embodiment of this disclosure.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1a, 1b). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, and "a" and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination of sub-combination of two or more such features, along with any other features which may not necessarily be expressly described or inherently present in the instant disclosure.

Broadly, embodiments of the inventive concepts disclosed herein are directed to passenger safety belt buckle structures and techniques for manufacturing the same. Traditional approaches for manufacturing safety belt buckle structures, such as metal casting, have worked well for various applications, but improvements in additive manufacturing (e.g., three-dimensional (3D) printing) and injection molding technology have opened up new possibilities for creating safety belt buckle structures, particularly customized safety belt buckle structures. In example embodiments of this disclosure, a safety belt buckle release member and/or base member may be formed by a plurality of printed device layers (e.g., printed metal and/or plastic device layers). For example, the release member can be formed by a plurality of printed device layers and a metal coating disposed over the plurality of printed device layers and/or by a plurality of printed metal layers. In this manner, the release member can be designed to include a 3D pattern and/or a 3D graphic (e.g., brand name, logo, advertisement, or any other symbol or text) on a top surface of the release member. In another example embodiment, the release member can include a recess with an in-mold feature disposed within the recess. For example, the release member can have an in-mold feature that includes a pattern, logo, image, text, or the like, embedded within a top surface of the release member.

FIGS. 1 through 7 illustrate example embodiments of a safety belt buckle 100 in accordance with various implementations. The safety belt buckle 100 includes a base member 102 and a release member 104 coupled to the base member. The release member 104 is configured to release a tongue held between the release member and the base member 102 when the release member 104 is pulled away from the base member 102. For example, a safety belt may include two strap portions that wrap around a passenger to secure the passenger to a seat or any other passenger support structure. The safety belt may have a tongue coupled to an end of a first strap portion and a safety belt buckle 100 coupled to an end of a second strap portion. The tongue can be configured to mate with the safety belt buckle 100. For example, the safety belt buckle 100 can include a slot 106 disposed at a front portion of the safety belt buckle 100 and configured to receive the tongue. The tongue is then held in between the base member 102 and the release member 104 until the passenger lifts or pulls the release member 104 away from the base member 102 to unlatch the tongue from the safety belt buckle 100.

Figure 2:
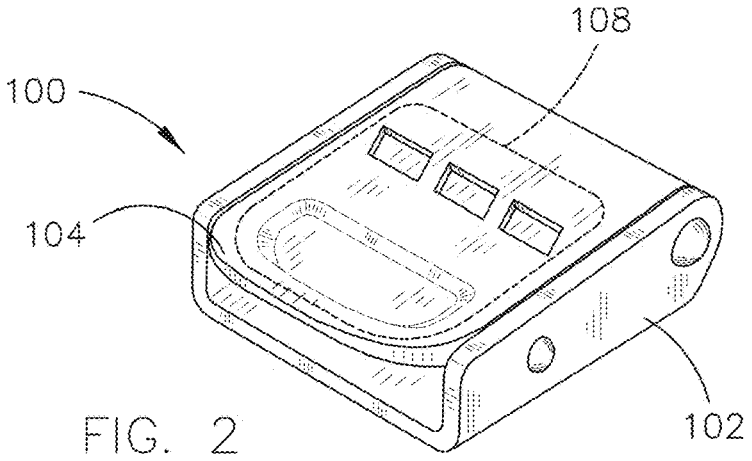
FIG. 2 is a perspective view of a safety belt buckle, in accordance with an embodiment of this disclosure.
Figure 3:
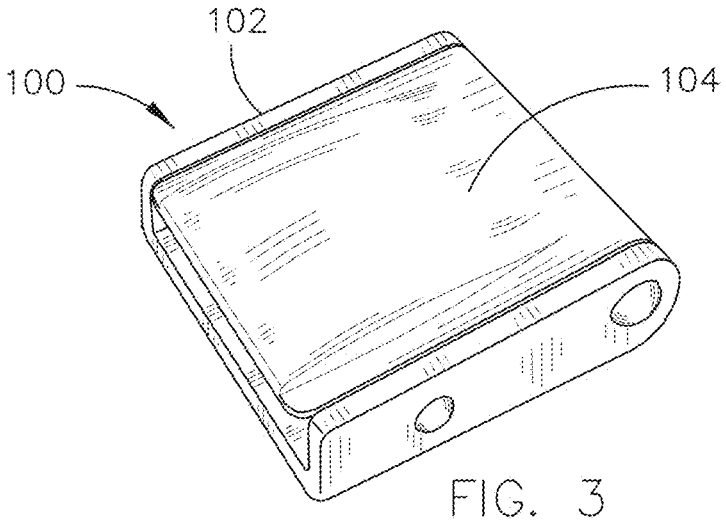
FIG. 3 is a perspective view of a safety belt buckle, in accordance with an embodiment of this disclosure.
Figure 4:
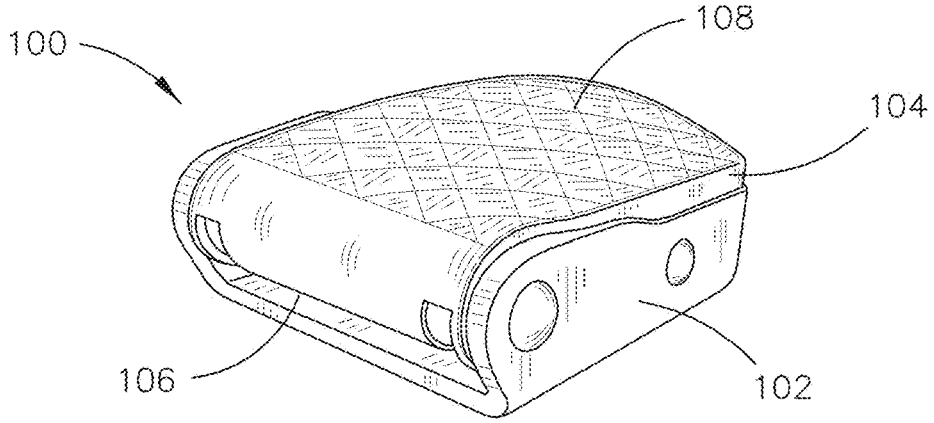
FIG. 4 is a perspective view of a safety belt buckle, in accordance with an embodiment of this disclosure.
Figure 5:
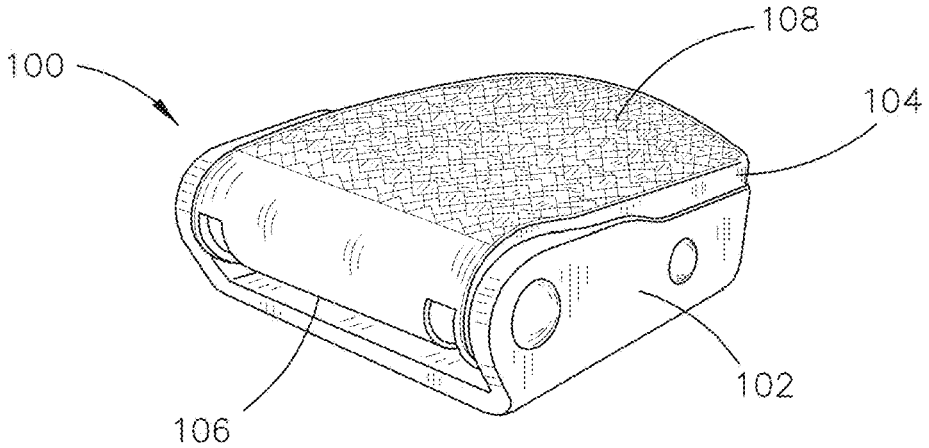
FIG. 5 is a perspective view of a safety belt buckle, in accordance with an embodiment of this disclosure.

As shown in FIGS. 1 through 7, the safety belt buckle 100 can be manufactured to have various design features and/or according to different form factors. For example, FIG. 1 illustrates an example embodiment of the safety belt buckle 100 with a simple design. FIG. 2 illustrates an example embodiment of the safety belt buckle 100 with a more complex design that includes a 3D pattern 108 of parallelograms formed on a top surface of the release member 104. The safety belt buckle 100 can also include other indentations or protuberances formed on the release member 104 and/or the base member 102. The safety belt buckle 100 may also include paint or other colored material (e.g., colored plastic, rubber, or metal) formed on the top surface, upon protuberances on the top surface, and/or within indentations formed in the top surface of the release member 104. FIGS. 4 and 5 also illustrate example embodiments of the safety belt buckle 100 with 3D patterns 108 on the top surface of the release member 104. In some embodiments, the 3D pattern 108 on a release member 104 (and/or a base member 102) includes a repeating pattern of geometric shapes. For example, the 3D pattern 108 in FIG. 4 includes repeating diamonds, and the 3D pattern in FIG. 5 includes repeating chevrons.

Figure 6:
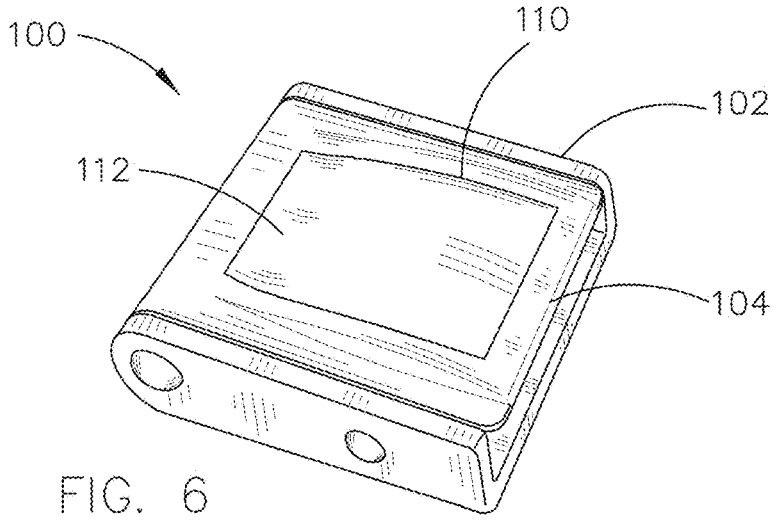
FIG. 6 is a perspective view of a safety belt buckle, in accordance with an embodiment of this disclosure.

FIG. 3 illustrates another example embodiment of the safety belt buckle 100 with a complex design that includes raised edges on the release member 104 for a more distinctive appearance. FIG. 6 illustrates an example embodiment of the safety belt buckle 100 with a design similar to the safety belt buckle 100 illustrated in FIG. 3, where the release member 104 includes a recess 110 with an in-mold feature 112 disposed (e.g., embedded) within the recess 110. For example, the in-mold feature 112 can be injection molded with the release member 104 structure and/or the release member 104 structure can be cast around the in-mold feature 112. It is noted that while an in-mold feature 112 is shown in combination with the safety belt buckle 100 structure of FIG. 3, any other safety belt buckle 100 (e.g., as shown in FIG. 1, 2, 3, or 4) can include an in-mold feature 112. In some embodiments, the in-mold feature 112 includes a pattern (e.g., a geometric pattern) or design. The in-mold feature 112 can additionally or alternatively include a brand name, a logo, and/or a message. In some embodiments, the in-mold feature 112 includes an informational message (e.g., a safety message or warning). In other embodiments, the in-mold feature 112 includes a promotional message (e.g., an advertisement). For example, the in-mold feature 112 can include an advertisement paid for by a commercial entity wishing to advertise products or services on an aircraft or other vehicle (e.g., bus, train, etc.) that includes the safety belt buckles 100.

In some implementations, an in-mold labeling (IML) or in-mold decorating (IMD) process can be used to add an in-mold feature 112 comprising a thin sheet/film embedded within the top surface of the release member 104 (e.g., where the release member 104 may be an injection molded structure). The sheet/film may have ink applied to the sheet/film. For example, the ink can be printed in the form of a pattern, grain, wording, miscellaneous branding, etc. This ink could be a single color or multicolor. The ink could also be applied to either side of the sheet/film. The sheet/film could range in thickness and texture type (including soft touch). Techniques other than IML/IMD can be implemented to achieve desired effects. This can include, but is not limited to, metallic pigments in the material, in mold painting, hydro dipping, electroplating, vacuum metalization, thermo/pressure forming, etc.

In other implementations, the in-mold feature 112 includes a film, sheet, or injection molded chip of plastic can be integrated into a designated area of the release member 104. This film, sheet, or injection molded chip can be held in with adhesive, mechanically, magnetically, or by other similar means. The film, sheet, or injection molded chip may have the option to be permanent or removable (e.g., interchangeable).

Various techniques can be used to embed an in-mold feature 112 within the release member 104 structure. For example, in some implementations, ink is printed on a sheet/film (potentially with a distorted image to compensate for the stretching/warping during the forming process). The sheet/film is thermoformed, pressure formed, or formed by any other forming technology to create the shape of the part. The sheet/film can be trimmed down to the desired shape of the part. Static electricity, mechanical fixtures, or other tools or devices are used to hold the sheet/film into an injection mold. Molten plastic is then flown into the mold behind the sheet/film, filling the cavity and causing the sheet/film and injection molding material to become one complete item (e.g., the release member 104 with the in-mold feature 112 embedded therein).

Figure 7:
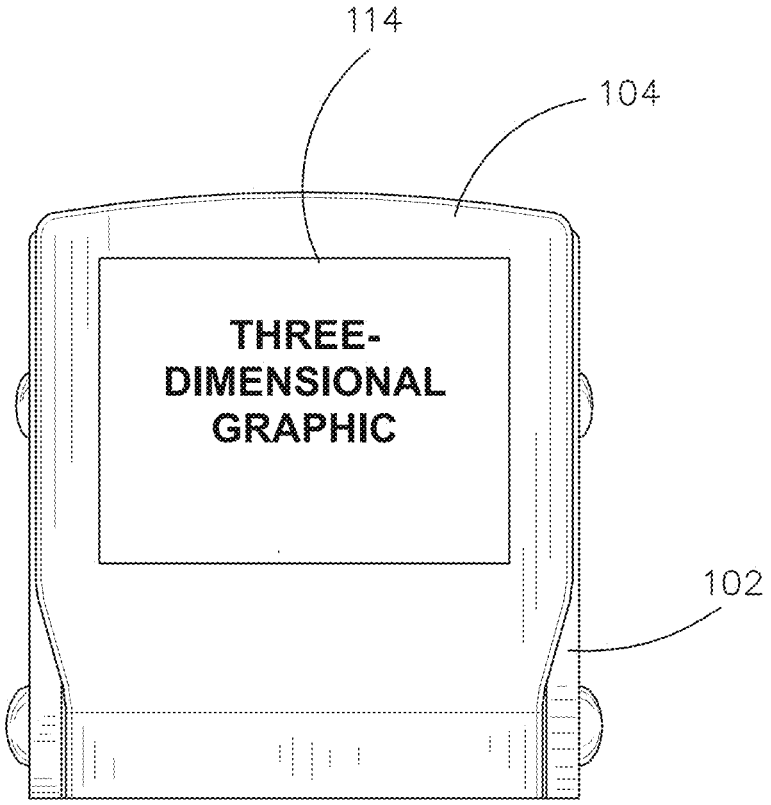
FIG. 7 is a top view of a safety belt buckle, in accordance with an embodiment of this disclosure.

FIG. 7 illustrates an example embodiment of the safety belt buckle 100 with the release member 104 including a 3D graphic 114 printed on a top surface of the release member 104. For example, the 3D graphic 114 may be formed by one or more printed device layers of a plurality of printed device layers that form the release member 104 and/or the base member 102 of the safety belt buckle 100. In some embodiments, the 3D graphic 114 includes a 3D pattern (e.g., a geometric pattern) or design. The 3D graphic 114 can additionally or alternatively include a brand name, a logo, and/or a message. In some embodiments, the 3D graphic 114 includes an informational message (e.g., a safety message or warning). In other embodiments, the 3D graphic 114 includes a promotional message (e.g., an advertisement). For example, the 3D graphic 114 can include an advertisement paid for by a commercial entity wishing to advertise products or services on an aircraft or other vehicle (e.g., bus, train, etc.) that includes the safety belt buckles 100. In some embodiments, the 3D graphic 114 has paint or other colored material (e.g., colored plastic, rubber, or metal) disposed upon and/or forming a portion of the 3D graphic 114.

Figure 8:
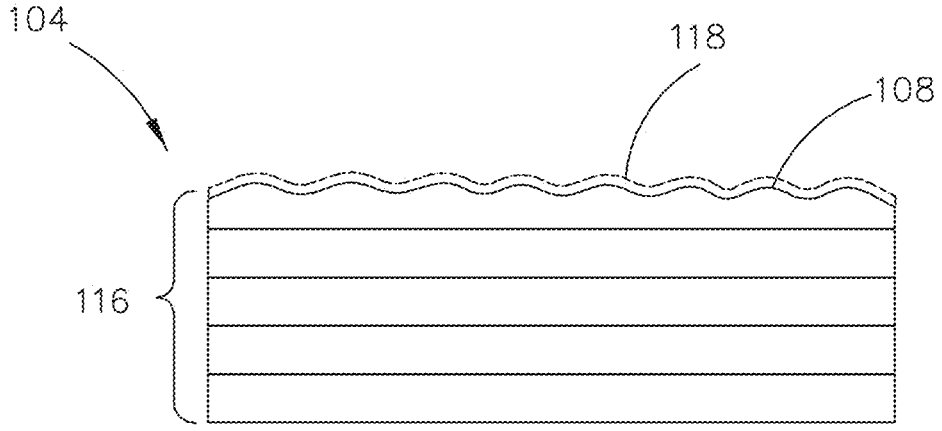
FIG. 8 is a partial cross-sectional view of a release member of a safety belt buckle, in accordance with an embodiment of this disclosure.

FIG. 8 illustrates a cross-sectional view of the release member 104 of the safety belt buckle 100 in accordance with an example embodiment of this disclosure. The release member 104 can be formed by a plurality of printed device layers 116 (e.g., printed metal and/or plastic device layers). In an example embodiment, the printed device layers 116 are metal device layers formed on top of one another using a 3D printer or other type of additive manufacturing device. One or more of the printed device layers 116 can form a 3D pattern 108 on a top surface of the release member 104. In some embodiments, a colored layer 118 (e.g., a paint layer, other colored material, and/or another (colored) printed device layer) is disposed upon the 3D pattern 108 to form colored portions of the 3D pattern 108.

Figure 9:
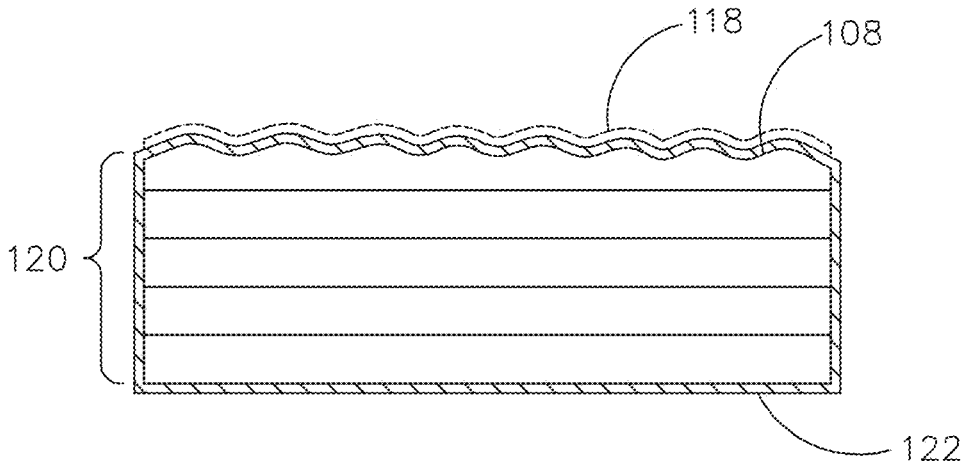
FIG. 9 is a partial cross-sectional view of a release member of a safety belt buckle, in accordance with an embodiment of this disclosure.

FIG. 9 illustrates a cross-sectional view of the release member 104 of the safety belt buckle 100 in accordance with another example embodiment of this disclosure. The release member 104 can be formed by a plurality of printed device layers 120 (e.g., printed metal and/or plastic device layers). A surface coating 122 (e.g., metallic coating, plastic coating, rubberized coating, or the like) can then be applied over the plurality of printed device layers 120. In an example embodiment, the printed device layers 120 are plastic device layers formed on top of one another using a 3D printer or other type of additive manufacturing device, and the surface coating 122 is a metal coating disposed upon the plurality of printed device layers 120. One or more of the printed device layers 120 can form a 3D pattern 108 on a top surface of the release member 104. In some embodiments, a colored layer 118 (e.g., a paint layer, other colored material, and/or another (colored) printed device layer) is disposed upon the 3D pattern 108 to form colored portions of the 3D pattern 108.

Figure 10:
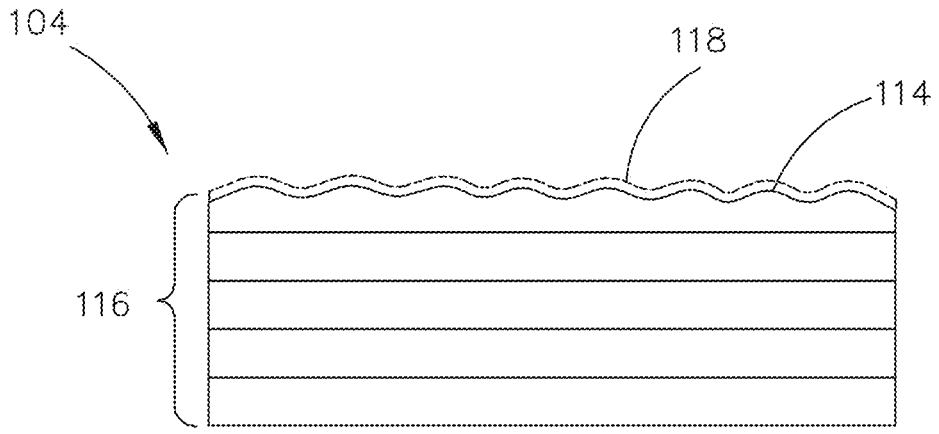
FIG. 10 is a partial cross-sectional view of a release member of a safety belt buckle, in accordance with an embodiment of this disclosure.

FIG. 10 illustrates a cross-sectional view of the release member 104 of the safety belt buckle 100 in accordance with another example embodiment of this disclosure. The release member 104 can be formed by a plurality of printed device layers 116 (e.g., printed metal and/or plastic device layers). In an example embodiment, the printed device layers 116 are metal device layers formed on top of one another using a 3D printer or other type of additive manufacturing device. One or more of the printed device layers 116 can form a 3D graphic 114 on a top surface of the release member 104. In some embodiments, a colored layer 118 (e.g., a paint layer, other colored material, and/or another (colored) printed device layer) is disposed upon the 3D graphic 114 to form colored portions of the 3D graphic 114.

Figure 11:
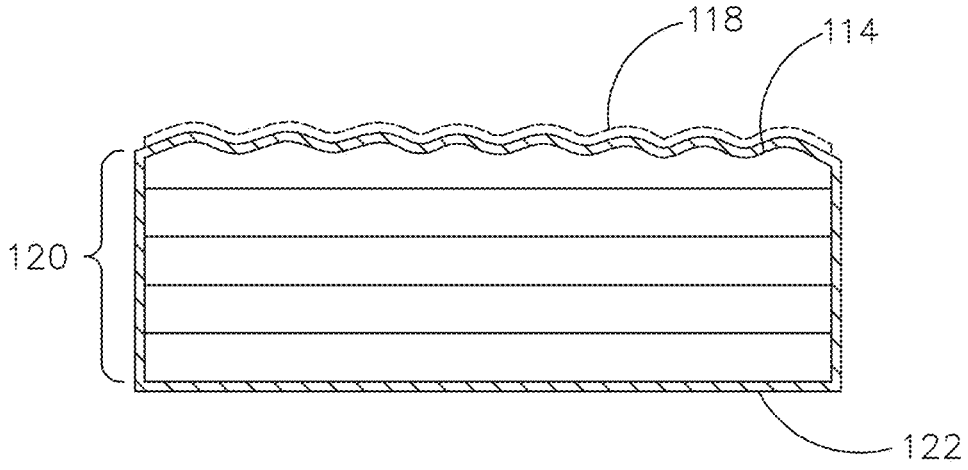
FIG. 11 is a partial cross-sectional view of a release member of a safety belt buckle, in accordance with an embodiment of this disclosure.

FIG. 11 illustrates a cross-sectional view of the release member 104 of the safety belt buckle 100 in accordance with another example embodiment of this disclosure. The release member 104 can be formed by a plurality of printed device layers 120 (e.g., printed metal and/or plastic device layers). A surface coating 122 (e.g., metallic coating, plastic coating, rubberized coating, or the like) can then be applied over the plurality of printed device layers 120. In an example embodiment, the printed device layers 120 are plastic device layers formed on top of one another using a 3D printer or other type of additive manufacturing device, and the surface coating 122 is a metal coating disposed upon the plurality of printed device layers 120. One or more of the printed device layers 120 can form a 3D graphic 114 on a top surface of the release member 104. In some embodiments, a colored layer 118 (e.g., a paint layer, other colored material, and/or another (colored) printed device layer) is disposed upon the 3D graphic 114 to form colored portions of the 3D graphic 114.

Figure 12C:
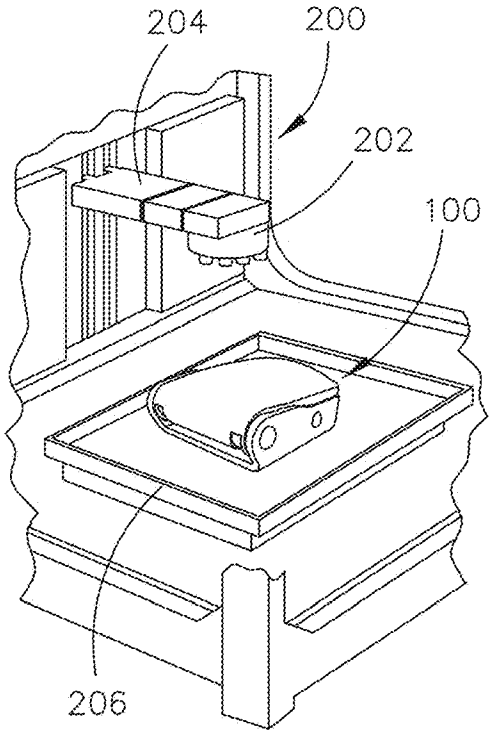
FIG. 12C is an illustration of a three-dimensional printer for manufacturing a safety belt buckle or a portion thereof, in accordance with an example embodiment of this disclosure.
Figure 12B:
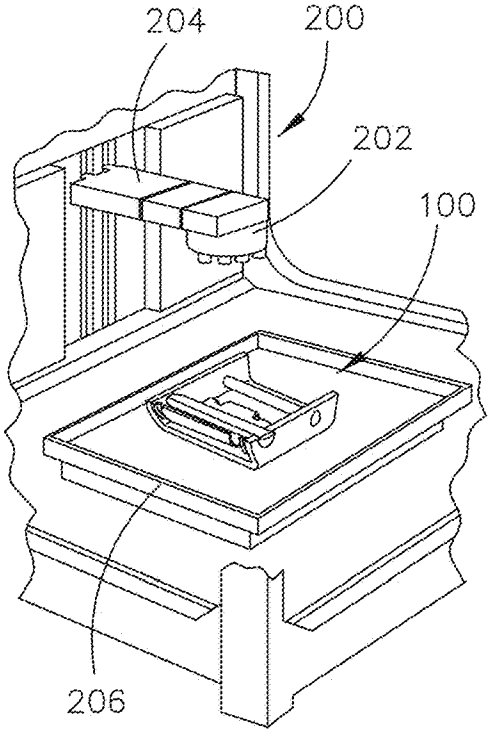
FIG. 12B is an illustration of a three-dimensional printer for manufacturing a safety belt buckle or a portion thereof, in accordance with an example embodiment of this disclosure.
Figure 12A:
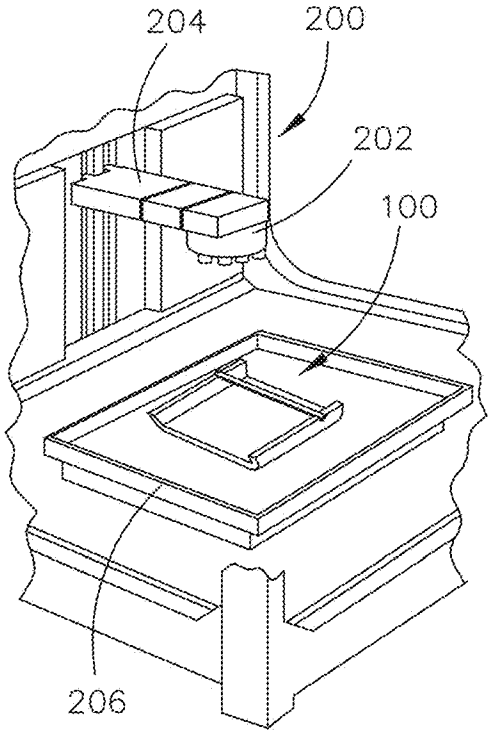
FIG. 12A is an illustration of a three-dimensional printer for manufacturing a safety belt buckle or a portion thereof, in accordance with an example embodiment of this disclosure.
Figure 13:
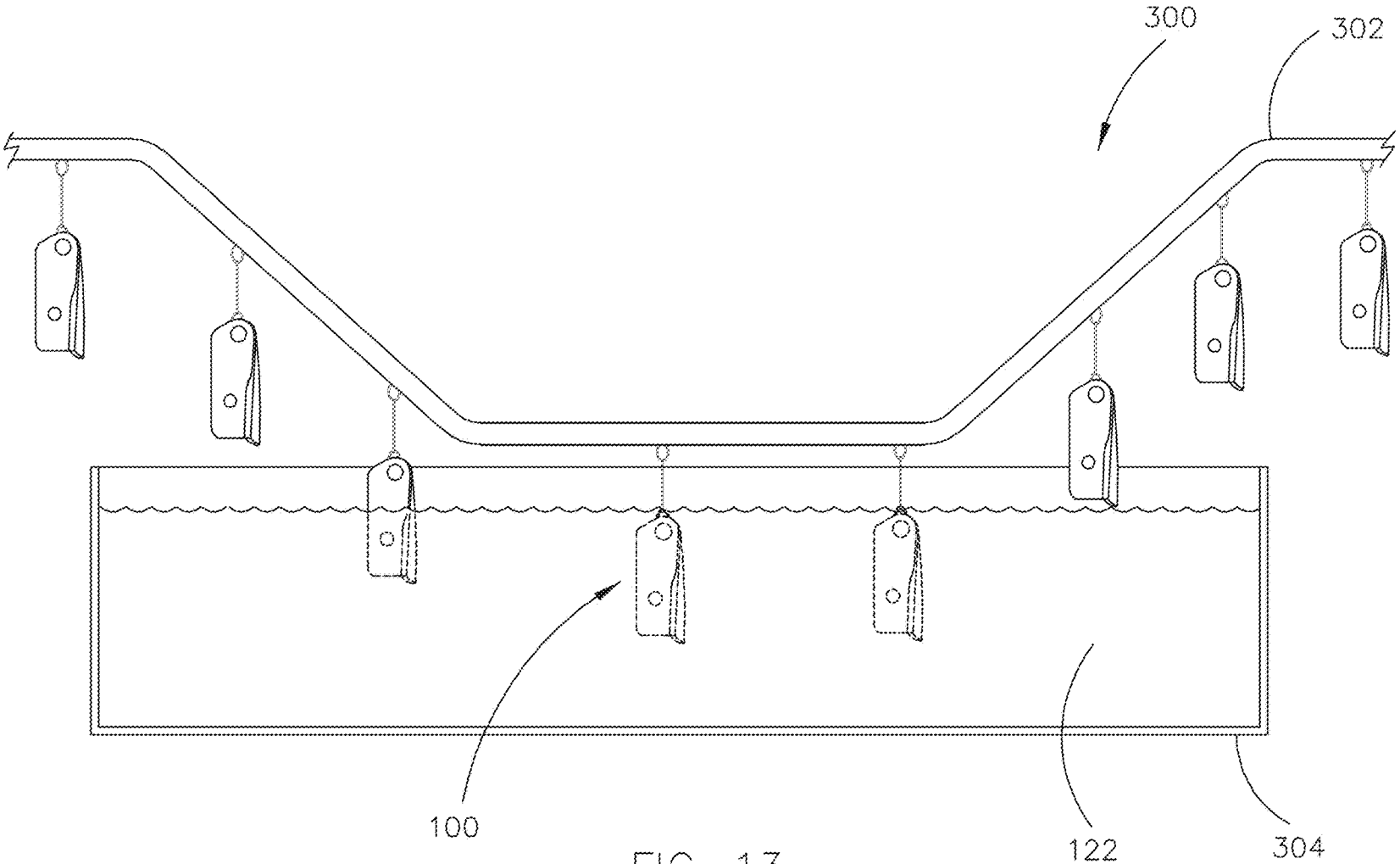
FIG. 13 is an illustration of a system for applying a surface coating to a safety belt buckle or a portion thereof, in accordance with an example embodiment of this disclosure.
Figure 14A:
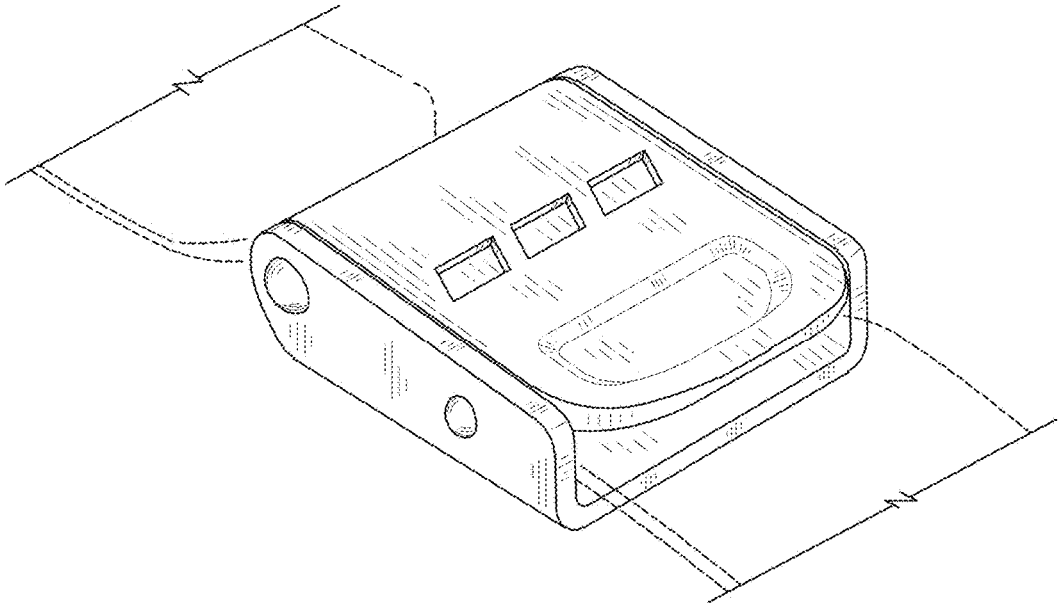
FIG. 14A is a perspective view of a safety belt buckle, in accordance with an example embodiment of this disclosure.
Figure 14B:
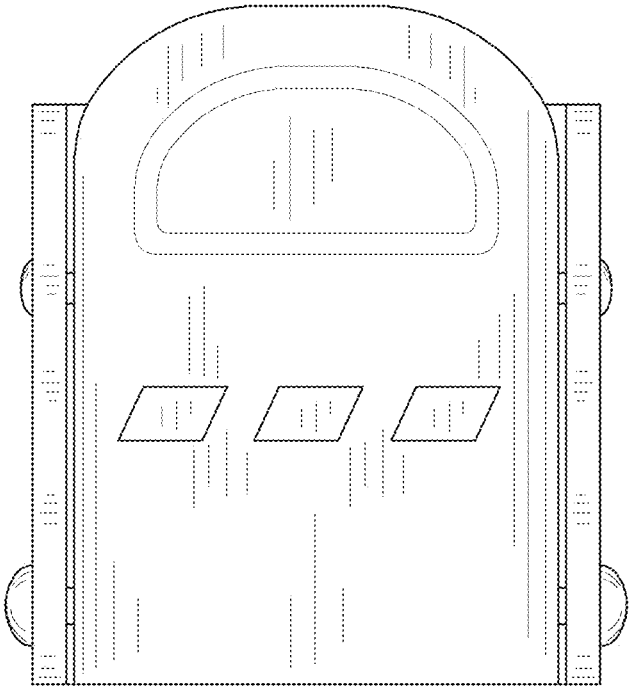
FIG. 14B is a top plan view of the safety belt buckle of FIG. 14A.
Figure 14C:
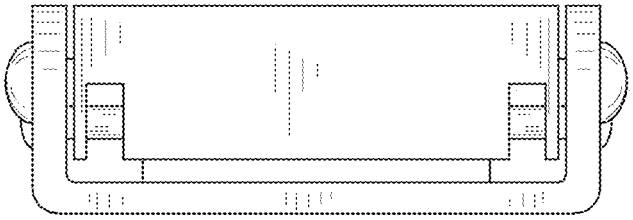
FIG. 14C is a front elevation view of the safety belt buckle of FIG. 14A.
Figure 14D:
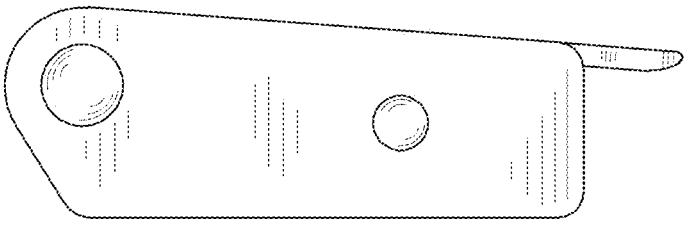
FIG. 14D is a left side elevation view of the safety belt buckle of FIG. 14A.
Figure 14E:
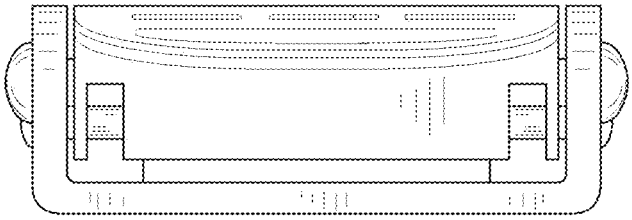
FIG. 14E is a rear elevation view of the safety belt buckle of FIG. 14A.
Figure 14F:
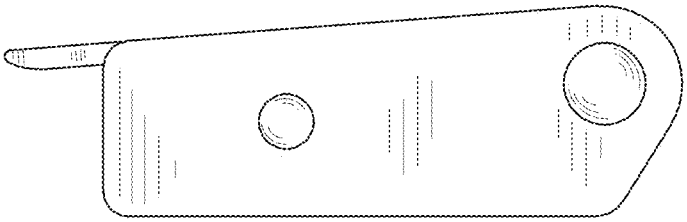
FIG. 14F is a right side elevation view of the safety belt buckle of FIG. 14A
Figure 14G:
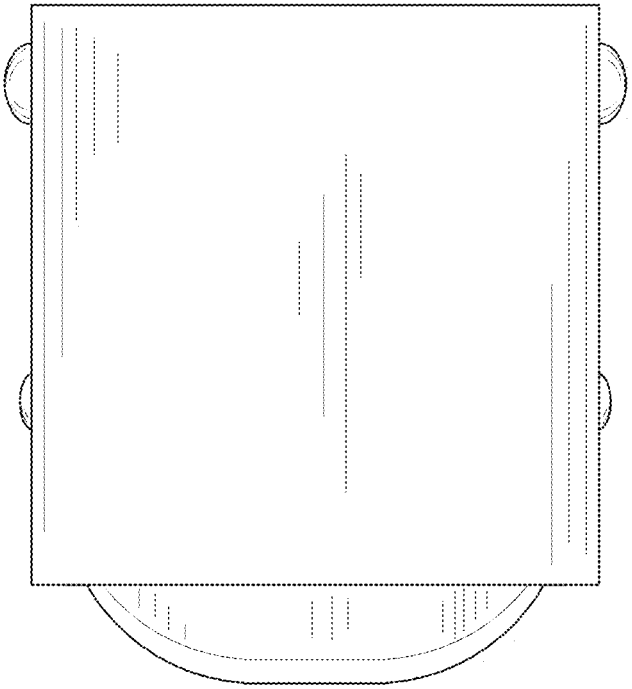
FIG. 14G is a bottom plan view of the safety belt buckle of FIG. 14A.
Figure 15A:
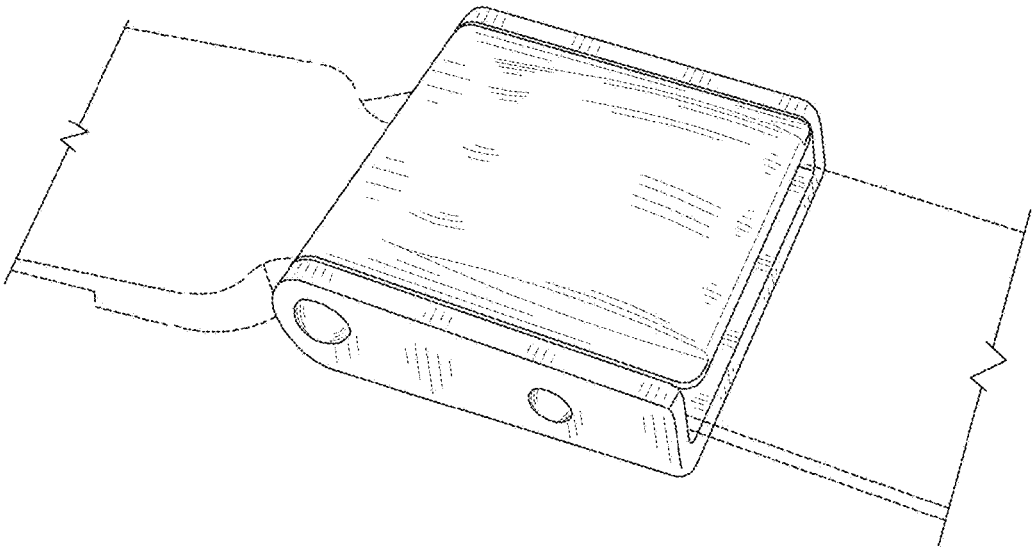
FIG. 15A is a perspective view of a safety belt buckle, in accordance with an example embodiment of this disclosure.
Figure 15B:
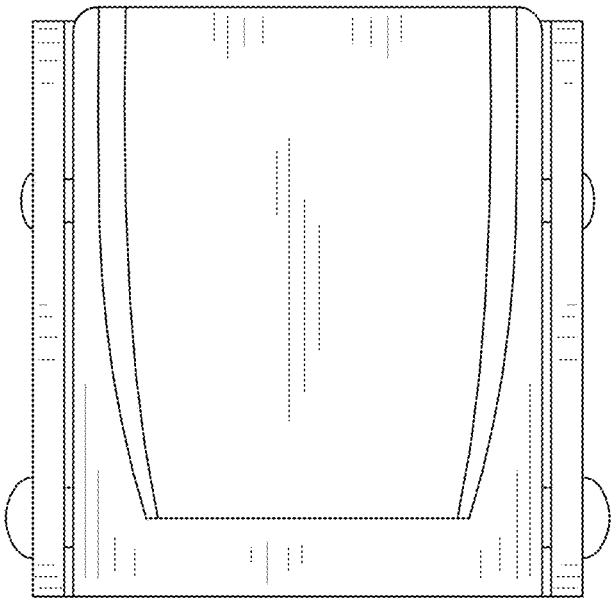
FIG. 15B is a top plan view of the safety belt buckle of FIG. 15A.
Figure 15C:
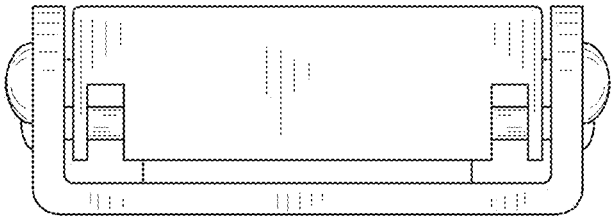
FIG. 15C is a front elevation view of the safety belt buckle of FIG. 15A.
Figure 15D:
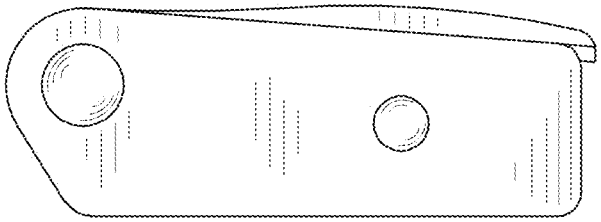
FIG. 15D is a left side elevation view of the safety belt buckle of FIG. 15A.
Figure 15E:
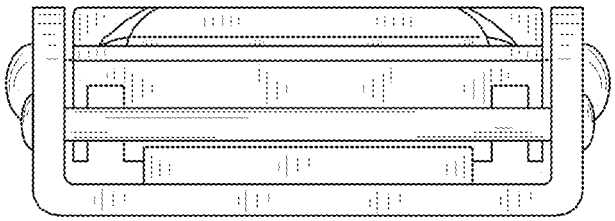
FIG. 15E is a rear elevation view of the safety belt buckle of FIG. 15A.
Figure 15F:
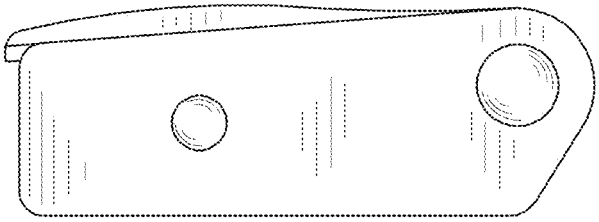
FIG. 15F is a right side elevation view of the safety belt buckle of FIG. 15A.
Figure 15G:
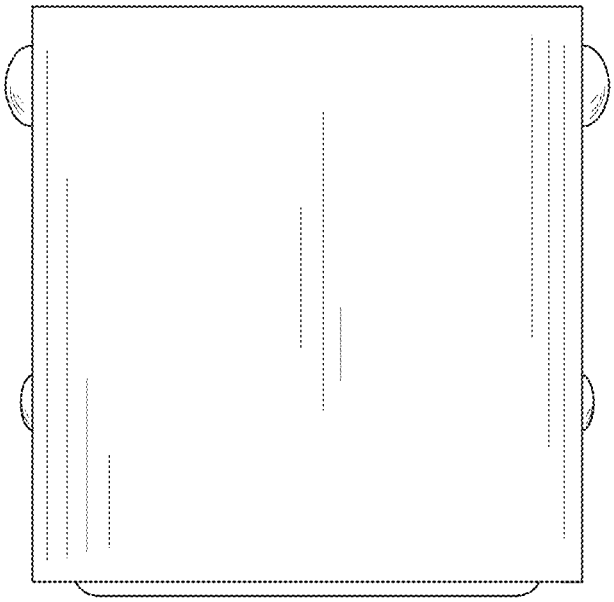
FIG. 15G is a bottom plan view of the safety belt buckle of FIG. 15A.
Figure 16A:
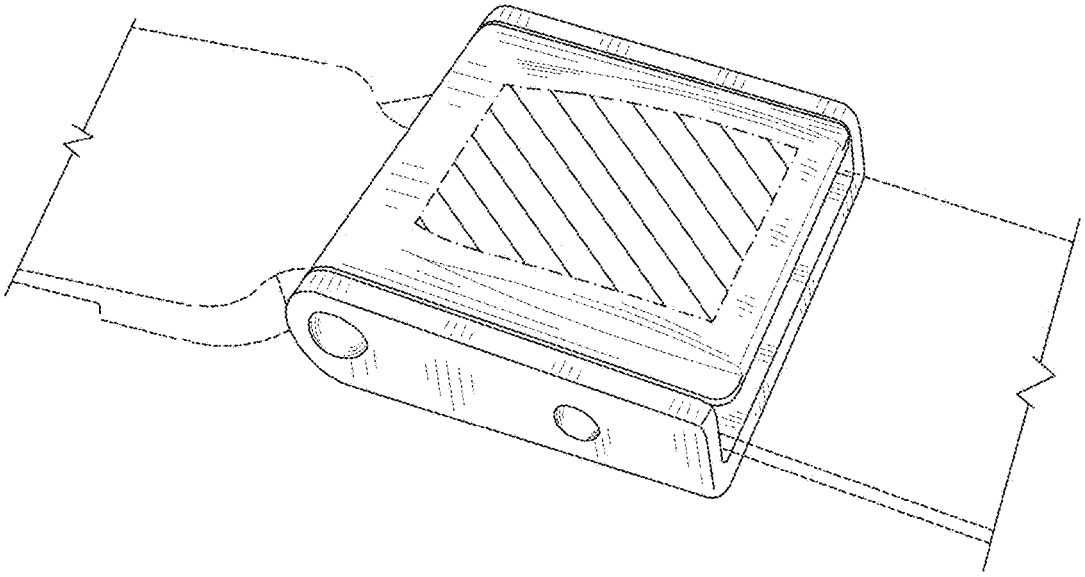
FIG. 16A is a perspective view of a safety belt buckle, in accordance with an example embodiment of this disclosure.
Figure 16B:
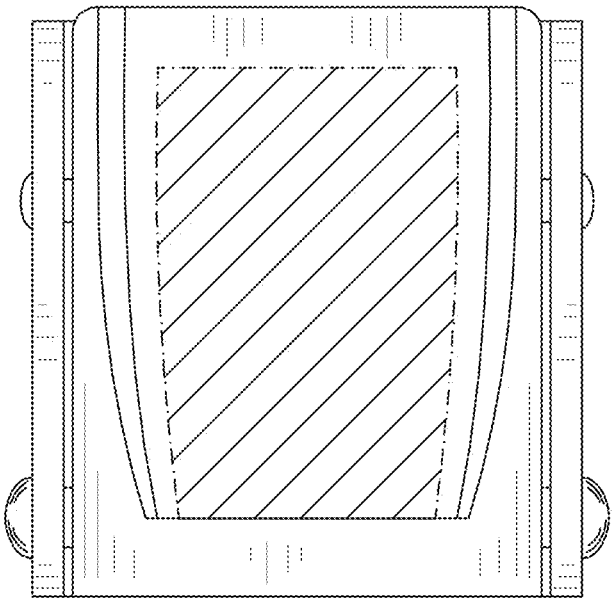
FIG. 16B is a top plan view of the safety belt buckle of FIG. 16A.
Figure 16C:
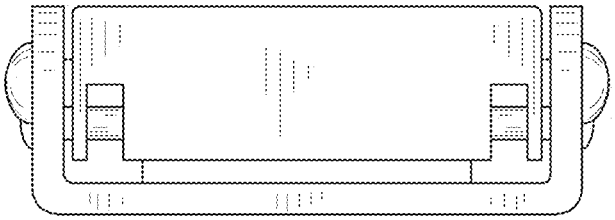
FIG. 16C is a front elevation view of the safety belt buckle of FIG. 16A.
Figure 16D:
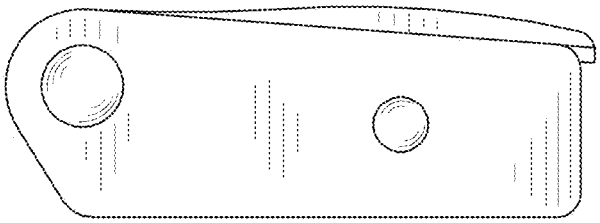
FIG. 16D is a left side elevation view of the safety belt buckle of FIG. 16A.
Figure 16E:
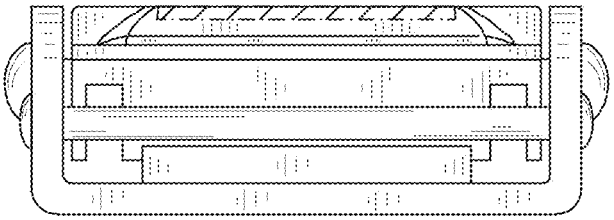
FIG. 16E is a rear elevation view of the safety belt buckle of FIG. 16A.
Figure 16F:
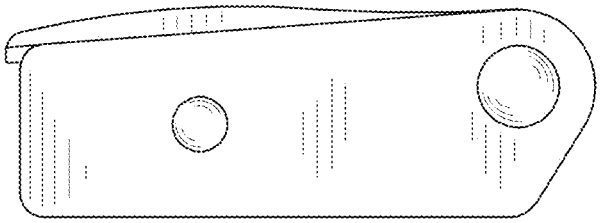
FIG. 16F is a right side elevation view of the safety belt buckle of FIG. 16A.
Figure 16G:
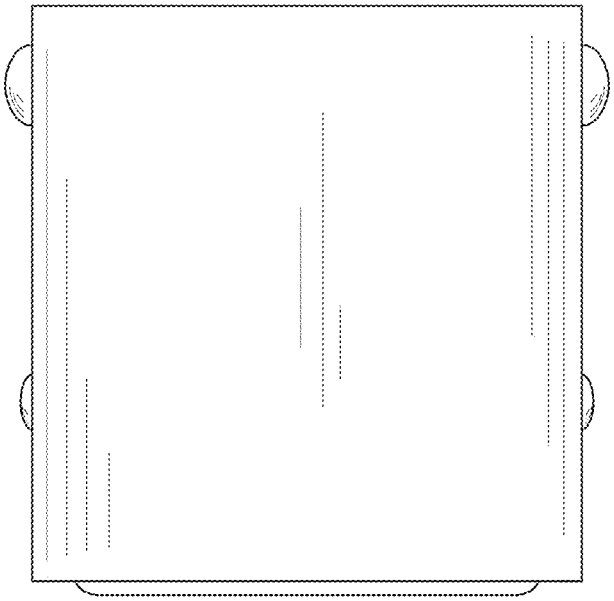
FIG. 16G is a bottom plan view of the safety belt buckle of FIG. 16A.
Figure 17A:
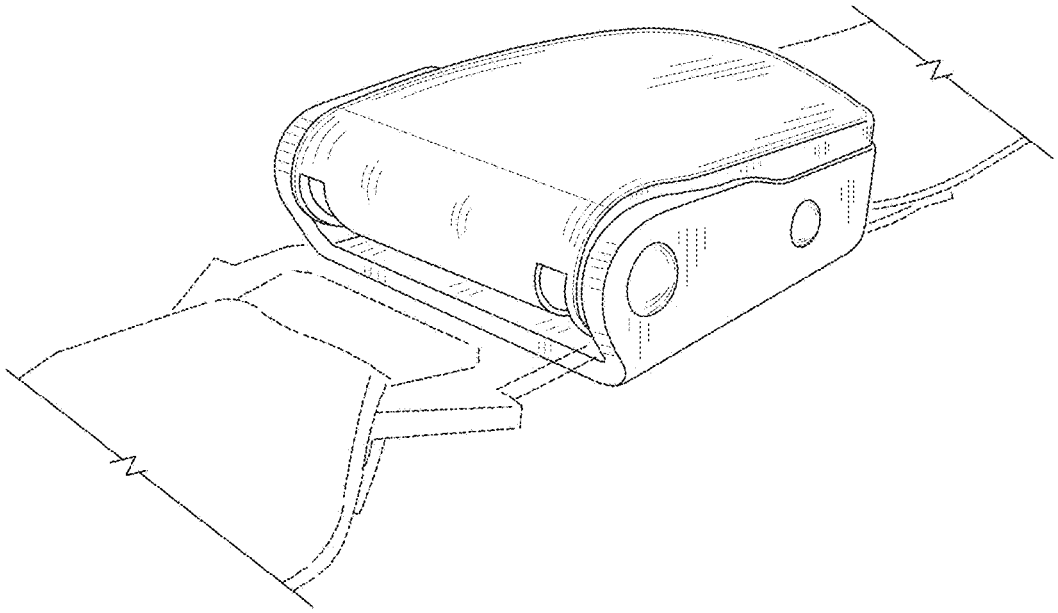
FIG. 17A is a perspective view of a safety belt buckle, in accordance with an example embodiment of this disclosure.
Figure 17B:
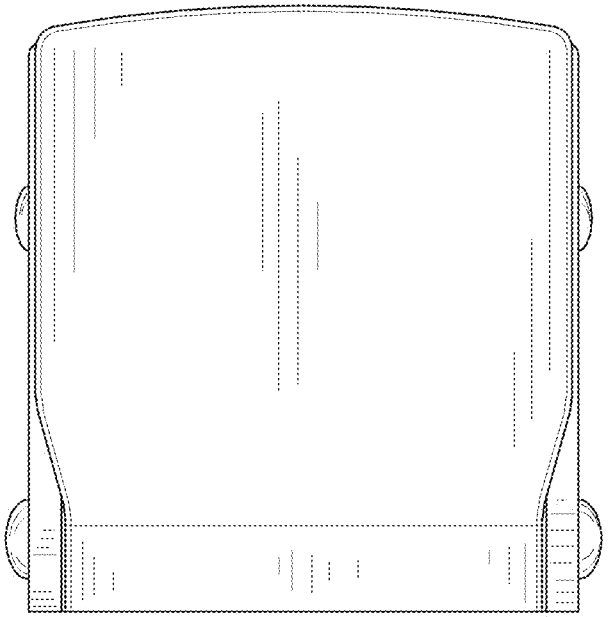
FIG. 17B is a top plan view of the safety belt buckle of FIG. 17A.
Figure 17C:
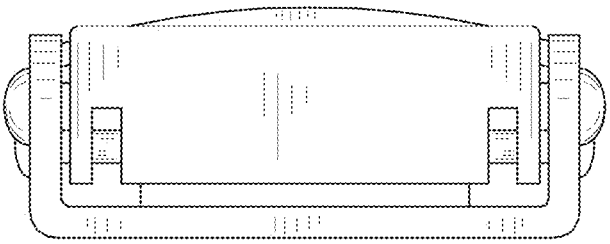
FIG. 17C is a front elevation view of the safety belt buckle of FIG. 17A.
Figure 17D:
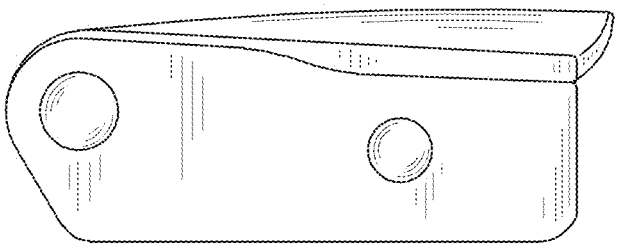
FIG. 17D is a left side elevation view of the safety belt buckle of FIG. 17A.
Figure 17E:
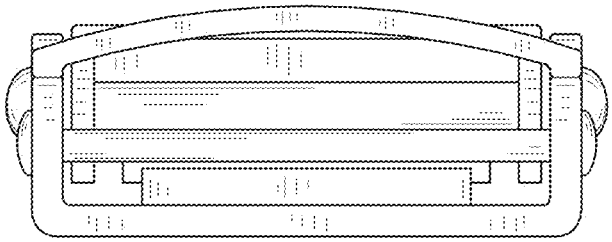
FIG. 17E is a rear elevation view of the safety belt buckle of FIG. 17A.
Figure 17F:
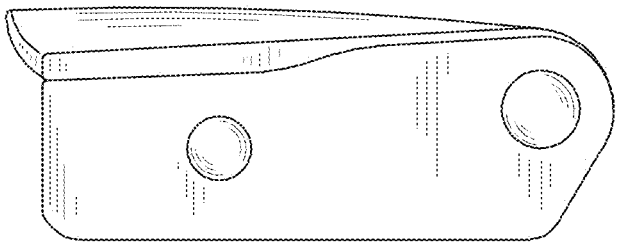
FIG. 17F is a right side elevation view of the safety belt buckle of FIG. 17A.
Figure 17G:
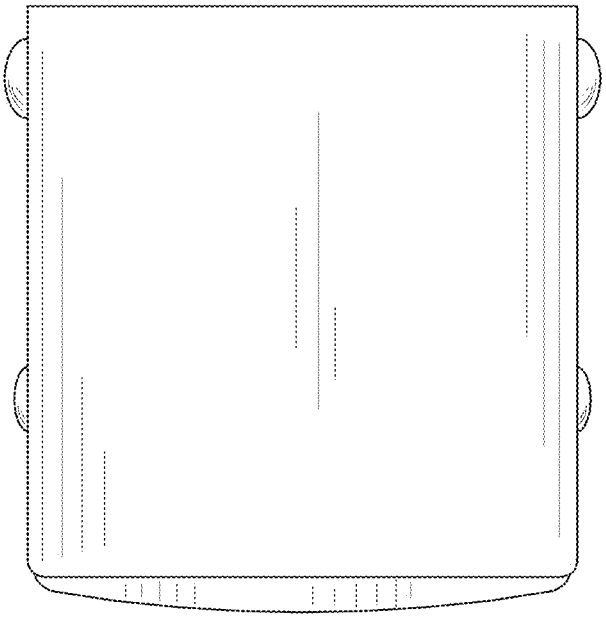
FIG. 17G is a bottom plan view of the safety belt buckle of FIG. 17A.
Figure 18A:
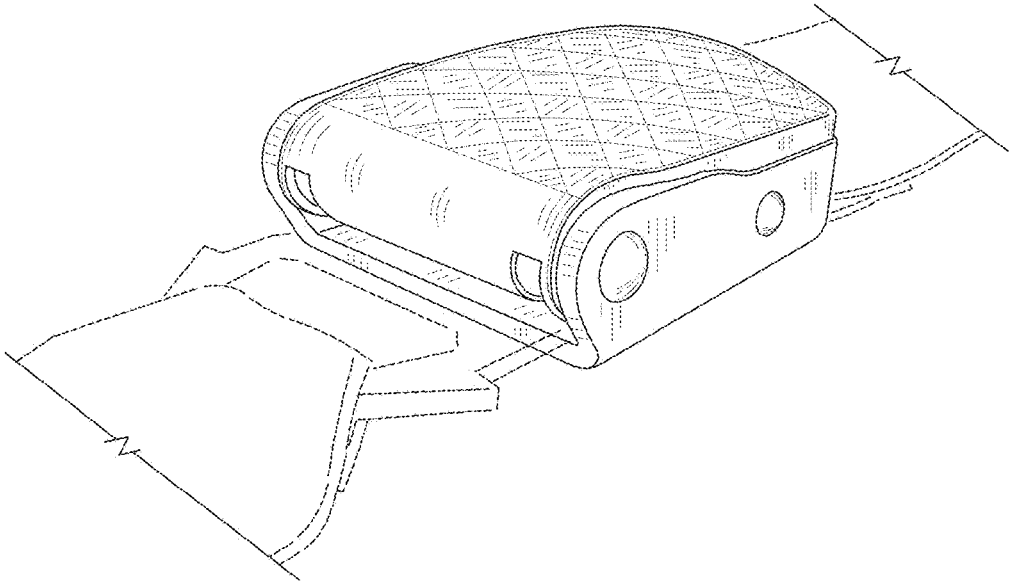
FIG. 18A is a perspective view of a safety belt buckle, in accordance with an example embodiment of this disclosure.
Figure 18B:
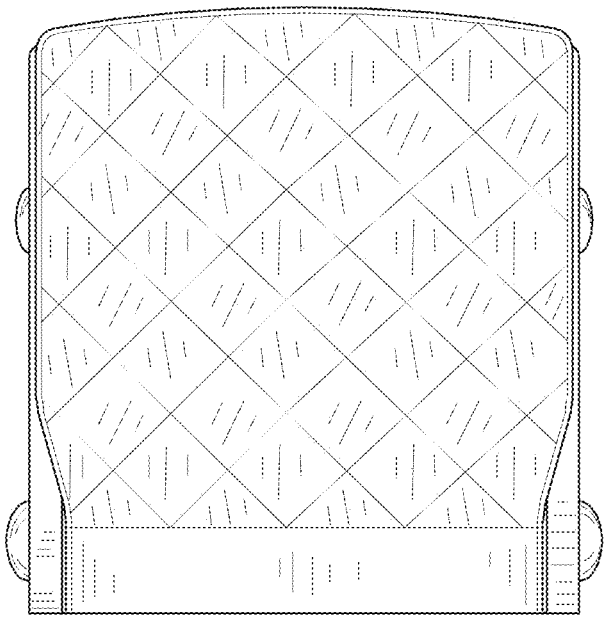
FIG. 18B is a top plan view of the safety belt buckle of FIG. 18A.
Figure 18C:
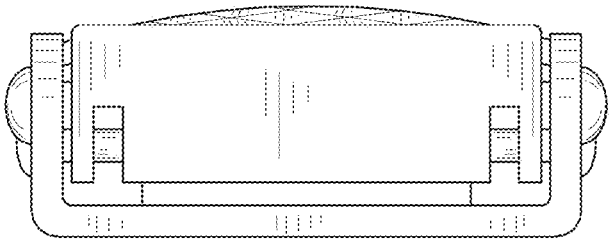
FIG. 18C is a front elevation view of the safety belt buckle of FIG. 18A.
Figure 18D:
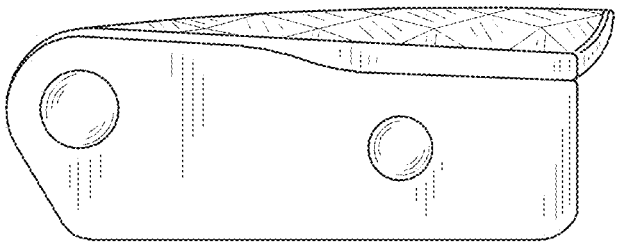
FIG. 18D is a left side elevation view of the safety belt buckle of FIG. 18A.
Figure 18E:
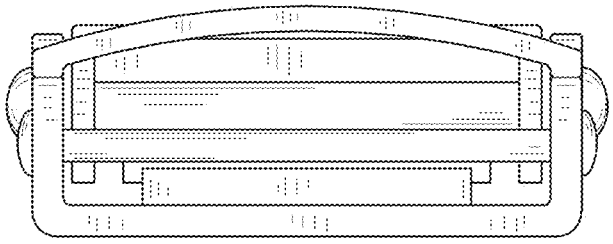
FIG. 18E is a rear elevation view of the safety belt buckle of FIG. 18A.
Figure 18F:
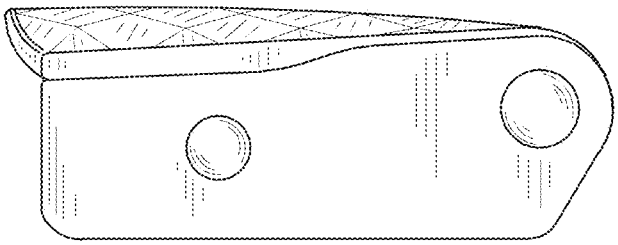
FIG. 18F is a right side elevation view of the safety belt buckle of FIG. 18A.
Figure 18G:
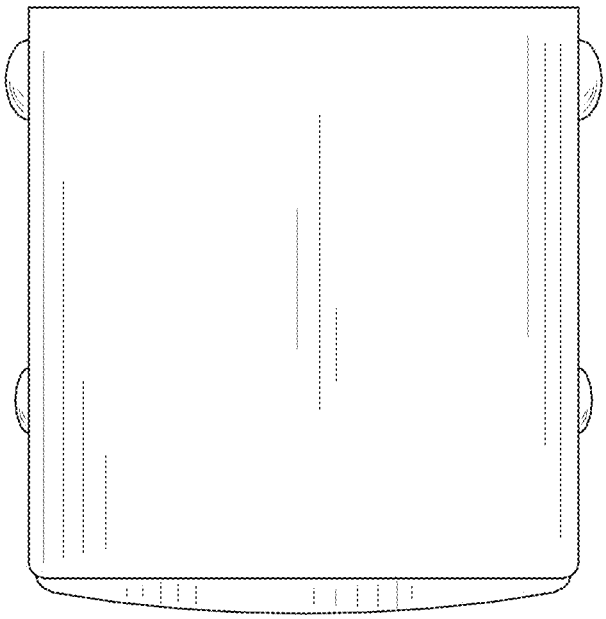
FIG. 18G is a bottom plan view of the safety belt buckle of FIG. 18A.
Figure 19A:
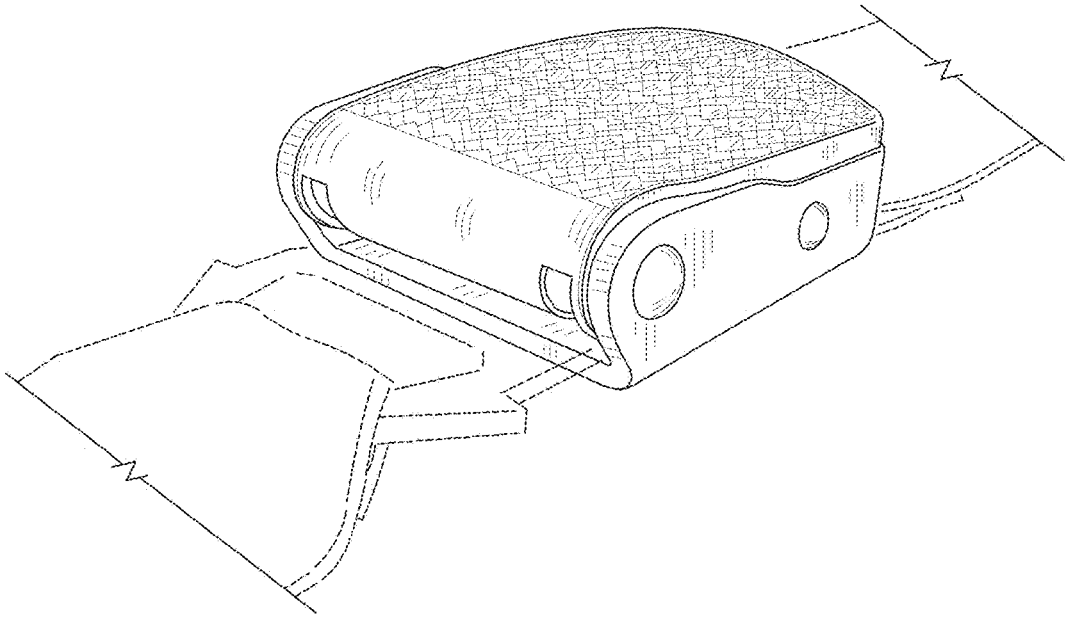
FIG. 19A is a perspective view of a safety belt buckle, in accordance with an example embodiment of this disclosure.
Figure 19B:
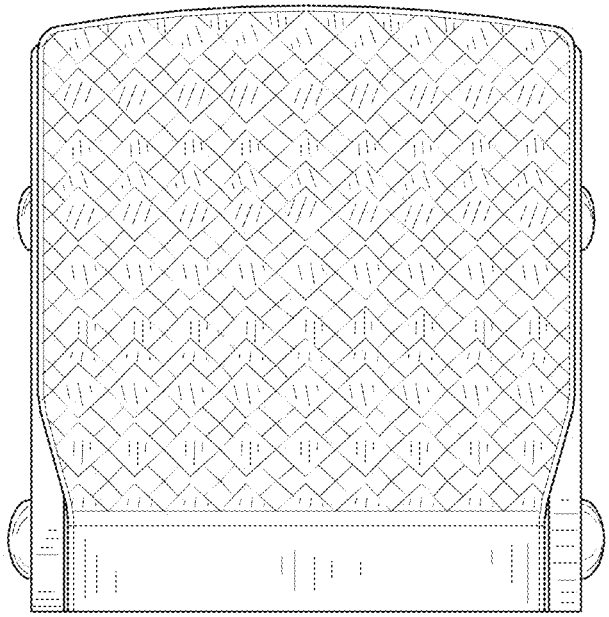
FIG. 19B is a top plan view of the safety belt buckle of FIG. 19A.
Figure 19C:
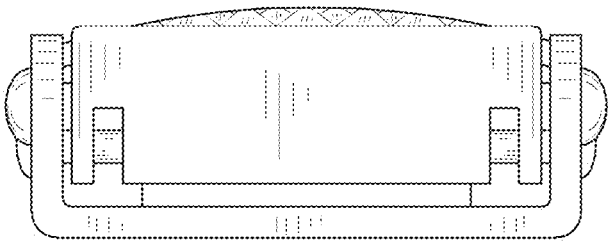
FIG. 19C is a front elevation view of the safety belt buckle of FIG. 19A.
Figure 19D:
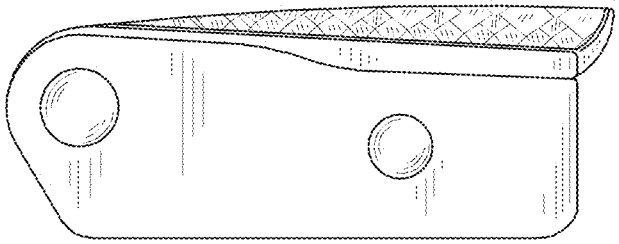
FIG. 19D is a left side elevation view of the safety belt buckle of FIG. 19A.
Figure 19E:
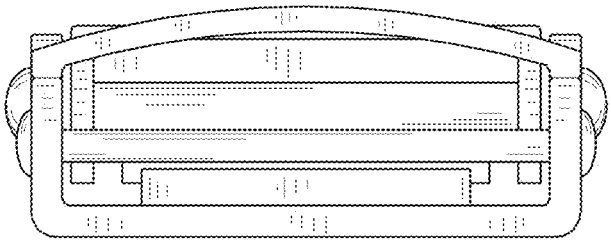
FIG. 19E is a rear elevation view of the safety belt buckle of FIG. 19A.
Figure 19F:
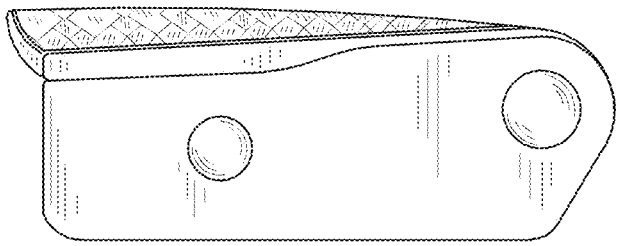
FIG. 19F is a right side elevation view of the safety belt buckle of FIG. 19A.
Figure 19G:
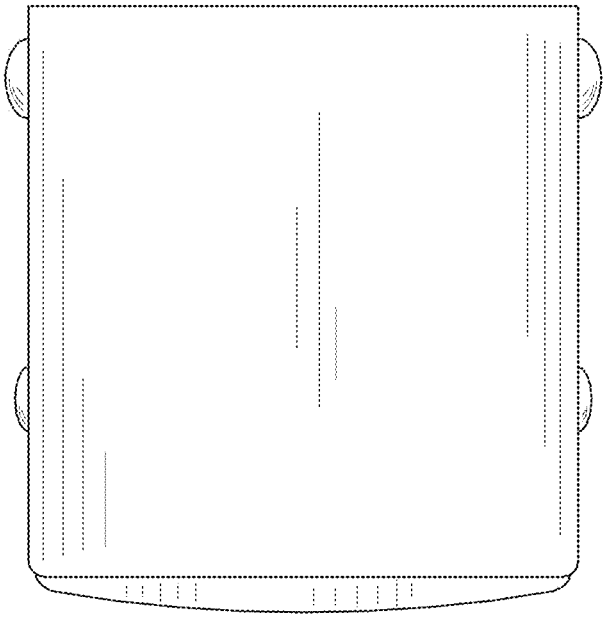
FIG. 19G is a bottom plan view of the safety belt buckle of FIG. 19A.

FIGS. 12A through 12C illustrate an example embodiment of a 3D printer 200 forming a plurality of printed device layers (e.g., printed device layers 116 or 120) to manufacture a safety belt buckle 100 or at least a portion thereof (e.g., the base member 102 and/or the release member 104). In embodiments, the 3D printer 200 includes one or more feeders configured to feed one or more strands of device material (e.g., metal and/or plastic 3D print filament) to a print nozzle 202 (or an assembly of print nozzles). The 3D printer 200 may further include a stage 206 configured to support printed device layers and an arm 204 configured to hold the print nozzle 202 above the stage 206. The stage 206 and/or the arm 204 can be configured to actuate (e.g., up, down, forwards, backwards, and/or sideways) so that the printed device layers can be disposed upon one another to form a 3D printed structure (e.g., base member 102 and/or release member 104). The 3D printer 200 illustrated in FIGS. 12A through 12C is provided as an example, and it is to be understood that other types of 3D printers can be employed.

In embodiments, the base member 102 and/or release member 104 structures (e.g., printed device layers 116 or 120) may be formed from any 3D printing material or combination of materials that meet structural specifications for the safety belt buckle 100 structures described herein. Some examples of 3D printing materials include, but are not limited to: Polylactic Acid (PLA) printing filament; Acrylonitrile Butadiene Styrene (ABS) printing filament; PRO Series PLA printing filament; PRO Series ABS printing filament; Polyamide (aka Nylon) printing filament; Polyamide With Chopped Carbon Fiber Strands (aka NylonX) printing filament; PRO Series Nylon printing filament; Polyethylene terephthalate (PET) printing filament; PETG printing filament; PETT printing filament; PRO Series PET, PETG, or PETT printing filament; Acrylonitrile Styrene Acrylate (ASA) printing filament; PolyPropylene (PP) printing filament; and combinations thereof. Any combination of the foregoing device materials may be included in example embodiments of the safety belt buckle 100 described herein. However, the foregoing list of device materials is not exhaustive, and it is contemplated that other device materials with similar structural properties and/or metals can be used in combination with or in place of the listed device materials.

In some embodiments, the safety belt buckle 100 or at least a portion thereof (e.g., base member 102 and/or release member 104) is plated or otherwise covered by a surface coating 122 (e.g., a metal coating). For example, FIGS. 9 and 11 illustrate example embodiments of the safety belt buckle 100 with a surface coating 122 disposed upon the printed layers 120 that form the release member 104. In an example implementation, the surface coating 122 is applied by a coating system 300 that includes a conveyer 302 configured to transport the safety belt buckle 100 or at least a portion thereof (e.g., base member 102 and/or release member 104) to a container 304 with surface coating material 122 (e.g., electroplating solution) disposed therein. The safety belt buckle 100 structure (e.g., base member 102 and/or release member 104) can then be submerged within the surface coating material 122 to cover the safety belt buckle 100 structure (e.g., base member 102 and/or release member 104) with the surface coating 122. In other implementations, the surface coating material 122 can be poured onto or otherwise deposited onto the surface of the safety belt buckle 100 structure (e.g., base member 102 and/or release member 104).

FIGS. 14A through 19G illustrate additional views of some of the example embodiments of the safety belt buckle 100 described herein. For example, FIGS. 14A through 14G illustrate additional views of the example embodiment of the safety belt buckle 100 illustrated in FIG. 2; FIGS. 15A through 15G illustrate additional views of the example embodiment of the safety belt buckle 100 illustrated in FIG. 3; FIGS. 16A through 16G illustrate additional views of the example embodiment of the safety belt buckle 100 illustrated in FIG. 6; FIGS. 17A through 17G illustrate additional views of the example embodiment of the safety belt buckle 100 illustrated in FIG. 1; FIGS. 18A through 18G illustrate additional views of the example embodiment of the safety belt buckle 100 illustrated in FIG. 4; and FIGS. 19A through 19G illustrate additional views of the example embodiment of the safety belt buckle 100 illustrated in FIG. 5.

It is to be understood that embodiments of the methods according to the inventive concepts disclosed herein may include one or more of the steps described herein. Further, such steps may be carried out in any desired order and two or more of the steps may be carried out simultaneously with one another. Two or more of the steps disclosed herein may be combined in a single step, and in some embodiments, one or more of the steps may be carried out as two or more sub-steps. Further, other steps or sub-steps may be carried in addition to, or as substitutes to one or more of the steps disclosed herein.

From the above description, it is clear that the inventive concepts disclosed herein are well adapted to carry out the objects and to attain the advantages mentioned herein as well as those inherent in the inventive concepts disclosed herein. While presently preferred embodiments of the inventive concepts disclosed herein have been described for purposes of this disclosure, it will be understood that numerous changes may be made which will readily suggest themselves to those skilled in the art and which are accomplished within the broad scope and coverage of the inventive concepts disclosed and claimed herein.

What is claimed is:

1. A safety belt buckle, comprising:

a base member; and a release member coupled to the base member, the release member configured to release a tongue held between the release member and the base member when the release member is pulled away from the base member, the release member comprising a plurality of printed device layers and a metal coating disposed over the plurality of printed device layers.

2. The safety belt buckle of claim 1, wherein the plurality of printed device layers form three-dimensional pattern on the release member.

3. The safety belt buckle of claim 2, wherein the three-dimensional pattern includes a repeating pattern of geometric shapes.

4. The safety belt buckle of claim 2, further comprising a paint layer disposed upon the three-dimensional pattern.

5. The safety belt buckle of claim 1, wherein the plurality of printed device layers form a three-dimensional graphic on the release member.

6. The safety belt buckle of claim 5, wherein the three-dimensional graphic includes at least one of a brand name or a logo.

7. The safety belt buckle of claim 5, wherein the three-dimensional graphic includes at least one of a promotional message or an informational message.

8. The safety belt buckle of claim 5, further comprising a paint layer disposed upon the three-dimensional graphic.

9. A safety belt buckle, comprising:

a base member; and a release member coupled to the base member, the release member configured to release a tongue held between the release member and the base member when the release member is pulled away from the base member, the release member comprising a plurality of printed metal layers.

10. The safety belt buckle of claim 9, wherein the plurality of printed metal layers form three-dimensional pattern on the release member.

11. The safety belt buckle of claim 10, wherein the three-dimensional pattern includes a repeating pattern of geometric shapes.

12. The safety belt buckle of claim 10, further comprising a paint layer disposed upon the three-dimensional pattern.

13. The safety belt buckle of claim 9, wherein the plurality of printed metal layers form a three-dimensional graphic on the release member.

14. The safety belt buckle of claim 13, wherein the three-dimensional graphic includes at least one of a brand name or a logo.

15. The safety belt buckle of claim 13, wherein the three-dimensional graphic includes at least one of a promotional message or an informational message.

16. The safety belt buckle of claim 13, further comprising a paint layer disposed upon the three-dimensional graphic.

* * * * *